United States Patent [19]

Salomon

[11] 4,335,531

[45] Jun. 22, 1982

[54] CROSS COUNTRY SKI BOOT

[75] Inventor: Georges P. J. Salomon, Annecy, France

[73] Assignee: Etablissements Francois Salomon & Fils, Annecy, France

[21] Appl. No.: 179,854

[22] Filed: Aug. 20, 1980

[30] Foreign Application Priority Data

Aug. 24, 1979 [FR] France ..... 79 21354

[51] Int. Cl.[3] ..... A43B 5/04

[52] U.S. Cl. ..... 36/117

[58] Field of Search ..... 36/117, 118, 119, 120, 36/121

[56] References Cited

U.S. PATENT DOCUMENTS 4,177,584 12/1979 Beyl ..... 36/117

4,245,409 1/1981 Beyl ..... 36/117

4,290,213 9/1971 Salomon ..... 36/117

*Primary Examiner*—P. D. Lawson

*Attorney, Agent, or Firm*—Pollock, Vande Sande & Priddy

[57] ABSTRACT

A cross country ski boot comprises a sole of moulded plastics material having substantially the form of a rectangle elongated in the longitudinal direction in its central part. The sole presents, in the front plantar support zone, a central part of considerable thickness, with flat, relatively narrow lower surface, in contact with the top surface of the ski. This central part is divided into two by a longitudinal centering groove extending over the whole length of the central part of the sole and intended to cooperate with a rib of complementary shape provided on the top surface of the ski. On either side of the central part, the sole comprises two side portions whose thickness decreases towards the longitudinal edges of the sole, with flat or curved lower surfaces, inclined upwardly from the central part towards the longitudinal edges of the sole which are located at a level higher than that of the top face of the ski.

6 Claims, 7 Drawing Figures

CROSS COUNTRY SKI BOOT

BACKGROUND OF THE INVENTION

The invention relates to a cross country ski boot designed more particularly for racing.

Presently known cross country or langlauf ski boots generally comprise soles made of moulded plastics material. These soles are shaped so as to be fitted, at the front, to suitable binding devices ensuring the connection between the boot and the cross country ski solely at the front end of the boot. Known cross country ski boots have soles with flat lower face, whose width is greater than the width of the ski receiving the boot. Consequently, the boot projects laterally on either side of the ski.

Such an embodiment of the soles of cross country ski boots has a certain number of drawbacks. In the first place, a large quantity of plastics material is required for manufacturing each sole, since the thickness of the sole is large enough in the plantar support zone to obtain a sufficient rigidity of the boot in this zone where it is connected to the ski. Furthermore certain cross country ski boots may be provided with one or more longitudinal grooves opening in the lower surface of the sole, these grooves being adapted on longitudinal centering members fast with the ski, having for example a V-shaped section. These centering members thus ensure that the boot returns into correct longitudinal position at the end of the movement of the foot when the boot comes to rest, flat, on the ski. However, due to the provision of a flat horizontal surface on either side of the or each longitudinal centering groove, it may happen that, if the boot is slightly offset laterally during the movement of the foot, the groove of the sole is not placed exactly above the V-sectioned centering member, so that it is a marginal zone of the lower flat surface of the sole which comes into contact with the edge of the centering member. The boot does not therefore return into correct flat position on the ski but, on the contrary, it is held slightly inclined at a certain distance from the upper surface of the ski in a position of unstable equilibrium. These are therefore very considerable drawbacks, particularly in equipment used for racing.

SUMMARY OF THE INVENTION

It is an object of the present invention to remedy these various drawbacks by providing a boot of particularly simple design, of low cost price and always ensuring that the boot returns to the correct flat position on the ski at the end of movement of the foot.

To this end, this cross country ski boot comprising a sole of moulded plastics material having substantially the form of a rectangle elongated in the longitudinal direction in its central part, is characterised in that said sole presents, in the front plantar support zone, a central part of considerable thickness, with flat, relatively narrow lower surface, in contact with the top surface of the ski, which is divided into two by a longitudinal centering groove extending over the wole length of the central part of the sole and intended to cooperate with a rib of complementary shape provided on the top surface of the ski, and, on either side of this central part, two side portions whose thickness decreases towards the longitudinal edges of the sole, with flat or curved lower surfaces, inclined upwardly from the central part towards the longitudinal edges of the sole which are located at a level higher than that of the top face of the ski.

According to a further feature of the invention, the flat central part, separated into two by a longitudinal centering groove, extends rearwardly by a portion of smaller width constituting two longitudinal ribs surrounding the longitudinal centering groove, each of these ribs having a lower edge of very small width facing the top face of the ski, an outer face connecting this narrow edge to the rest of the sole, this outer face being inclined upwardly to the corresponding longitudinal edge of the sole. Moreover, these ribs give a certain rigidity in this zone of the sole, avoiding torsional deformations along its longitudinal axis.

The cross country ski boot according to the invention thus offers the advantage of being thick only in the central part of the front plantar support zone, the side portions being of considerably reduced thickness with respect to the conventional soles with flat lower face over the whole of their width. This results in a considerable saving of moulded plastics material for each sole and consequently in a reduction in the cost price.

Furthermore, the two ribs which surround the longitudinal centering groove, to the rear of the flat portions provided in the front plantar support zone, due to their inclined outer side faces, avoid the boot being stopped, during the movement of the foot, in a position of unstable equilibrium: in fact, if during this movement, the longitudinal centering groove does not engage on the rib of complementary shape provided on the ski, the boot will still return flat on the top face of the ski, as the lower edge of one of the ribs of the sole will slide on the edge ot the centering member provided on the ski and on the inclined face thereof, this face then forming guide ramp to guide the boot into a position a little to the left or a little to the right with respect to the centering member of the ski.

To perfect the equilibrium, flat, during walking, an auxiliary support member may be provided beneath the sole, in the side portion of the plantar support zone located on the outer side of the boot, said auxiliary member being disposed between the flat central part of small width, and the longitudinal edge of the sole. This auxiliary support member may be integral with the sole, by being moulded therewith, or be added and fixed thereto. In the first case, the auxiliary support member may be constituted by a wing, moulded with the sole, extending laterally towards the outside from the central flat part and terminating in a lower edge located substantially in the plane of the lower surface of this central flat part.

A lug glued or fixed in any other manner to the appropriate spot may also be used as added element.

BRIEF DESCRIPTION OF THE DRAWINGS

The invention will be more readily understood on reading the following description with reference to the accompanying drawings, in which.

DESCRIPTION OF PREFERRED EMBODIMENTS

Figure 1:
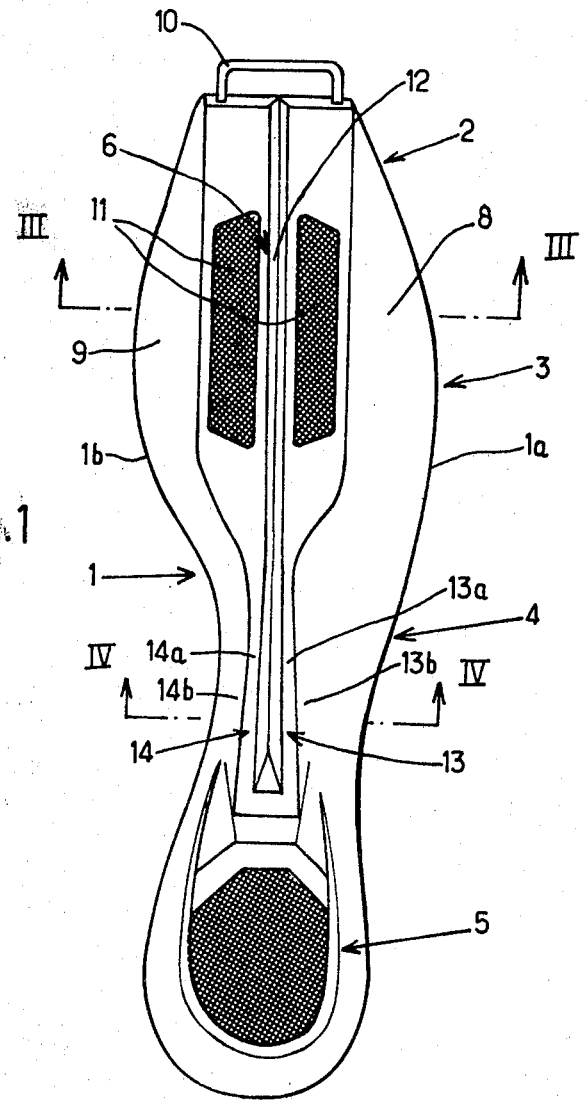
FIG. 1 is a view from underneath of a sole of a cross country ski boot according to the invention.

Referring now to the drawings, the cross country ski boot according to the invention shown in FIGS. 1 to 4 comprises a sole 1 made in one piece from a moulded plastics material. This sole 1 comprises a front end zone 2, by which the boot is connected to a binding device (not shown) then, going towards the rear, a front plantar support zone 3, an intermediate zone 4 located beneath the plantar arch, and finally a heel 5.

Figure 3:
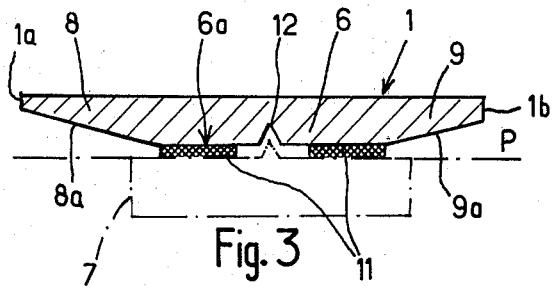
FIG. 3 is a view in vertical and transverse section made along line III—III of FIG. 1.
Figure 4:
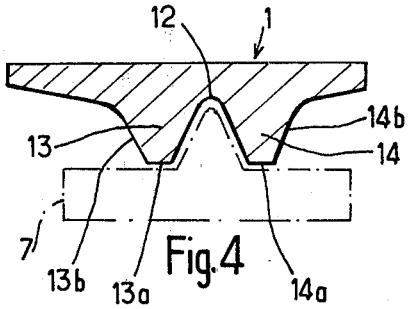
FIG. 4 is a view in vertical and transverse section made along line IV—IV of FIG. 1.

The sole 1 comprises, according to the invention, in its front plantar support zone 3, a central part 6 of considerable thickness, whose lower surface 6*a* is flat and horizontal, relatively narrow, of width smaller than or equal to that of the ski 7 (shown in dashed and dotted lines in the drawings) with which it alone is in contact. On either side of this central thick part 6, the sole 1 comprises two side portions 8 and 9 whose thickness decreases towards the outer and inner longitudinal edges 1*a* and 1*b* respectively of the sole 1. These side portions 8 and 9 are defined by lower surfaces 8*a* and 9*a* which are flat or preferably curved, as shown in FIG. 3, these lower surfaces 8*a*, 9*a* being inclined upwardly from the central part 6 towards the longitudinal edges 1*a*, 1*b*. The width of the side portion 8 which extends between the central part 6 and the outer longitudinal edge 1*a* is greater than that of the other side portion 9 extending between the central part 6 and the inner longitudinal edge 1*b*. From the foregoing, it is seen that, when the boot is placed flat on the ski, the longitudinal edges 1*a* and 1*b* of the sole are raised, at a level higher than that of the top face of the ski represented by plane P.

Due to this embodiment of the sole 1, all the volume of material between the lower surfaces 8*a*, 9*a* and the horizontal plane P is saved when manufacturing said sole.

To improve adherence, the lower flat surface 6*a* of the central part 6 is advantageously provided with one or more grip plates 11.

In the non-limiting embodiment shown in the drawing, the sole presents, in the central part 6 of the front plantar support zone 3, a longitudinal centering groove 12 whose cross section is for example in the form of an upturned V. Consequently the central part 6 which, in plane, is substantially in the form of a rectangle elongated in the longitudinal direction, is separated into two by the longitudinal centering groove 12 so that on either side of this groove 12 are two coplanar narrow flat surfaces, substantially rectangular in form, together constituting the lower surface 6*a*, and two grip plates 11.

The sole of the boot according to the invention furthermore presents, in the intermediate zone 4 between the front plantar support zone 3 and the heel 5, two ribs 13 and 14 surrounding the centering groove 12 which presents in this zone a greater depth than in the central zone 6. These ribs 13 and 14 respectively comprise lower edges 13*a* and 14*a* of small width facing the top face of the ski 7 and outer faces 13*b*, 14*b* connecting these edges 13*a*, 14*a* to the longitudinal edges 1*a*, 1*b* of the sole, these outer faces 13*b*, 14*b* being inclined upwardly towards the longitudinal edges 1*a*, 1*b*. When the boot rests flat on the ski, a longitudinal centering member 15, fixed on the top face of the ski 7, is engaged in the groove 12, over the whole length thereof, thus ensuring a lateral holding of the boot in position.

The two ribs 13, 14 which extend rearwardly as far as heel 5 serve to strengthen the boot in torsion about the longitudinal axis thereof, whilst allowing the flexion of the heel about a horizontal and transverse axis. The two ribs 13 and 14 also ensure a reinforcement against a torsion exerted about a vertical axis, i.e. perpendicularly to the ski.

As the two ribs 13, 14 terminate at the bottom by edges 13*a*, 14*a* of small width, it will be seen that, when the boot returns flat on the ski at the end of movement of the foot, this boot will automatically come flat on the ski, the centering member 15 fast with the ski 7 being able, or not, to engage in the longitudinal groove 12. In fact, if, due to a slight torsional offset about a vertical axis, one of the edges, for example edge 13*a*, abutted on the edge of the centering member 15, this position could not persist, since the edge 13*a* would slide on one side or the other of the centering member 15, on one of the inclined side faces thereof. One is thus sure of a return into flat position on the ski, even in the case of a slight lateral offset of the boot.

To perfect the equilibrium of the boot, when flat, during walking, an auxiliary support member may be additionally provided in the outer side portion 8 of the front plantar support zone 3, said auxiliary support member being disposed between the flat central part 6 and the outer longitudinal edge 1*a* of the boot.

Figure 5:
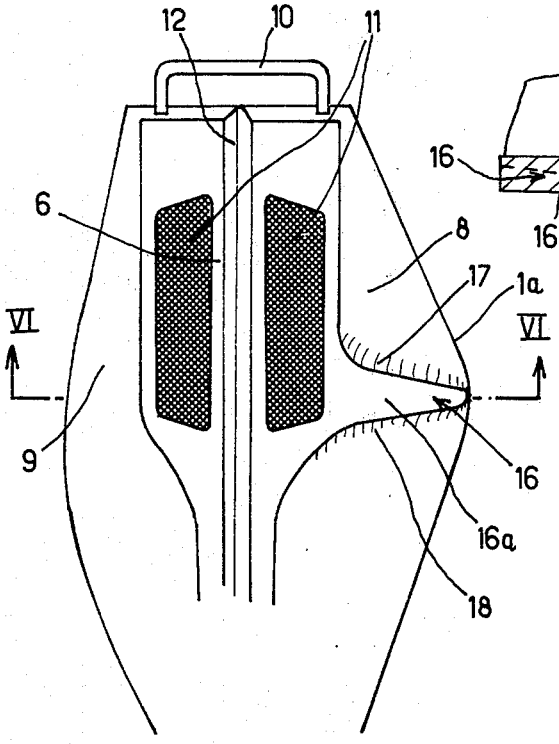
FIG. 5 is a partial view from underneath of the front plantar support zone of a sole of a variant embodiment of the invention.
Figure 6:
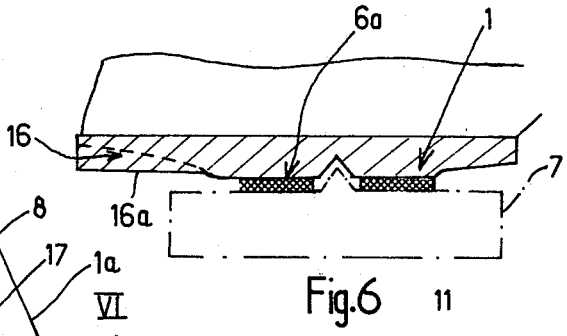
FIG. 6 is a view in vertical and transverse section made along line VI—VI of FIG. 5.
Figure 7:
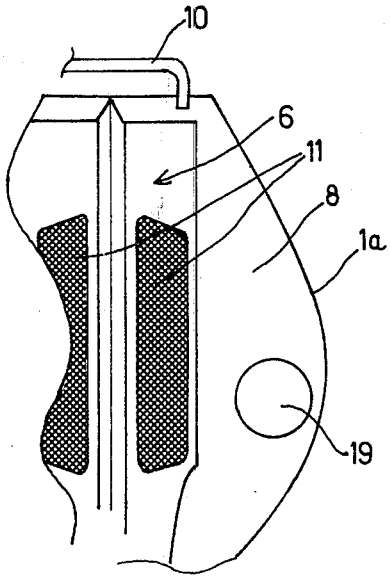
FIG. 7 is a partial view from underneath of another embodiment of a plantar support zone of a boot sole according to the invention.

This auxiliary support member may be moulded with the sole 1 as shown in FIGS. 5 and 6. In this case, this auxiliary support member is constituted by a wing 16 extending between the central part 6 and the longitudinal edge 1*a*, at the rear end of this central part 6. This wing 16 has a lower edge 16*a* located substantially in the plane of the flat lower surface 6*a* of the central part 6, this edge 16*a* being connected to the rest of the side portion 8 preferably by curved surfaces 17 and 18 facilitating the slide of the snow and clearing thereof.

From the foregoing, it will be seen that the lateral stability of the boot is increased due to the presence of the wing 16 constituting the auxiliary support member.

According to a variant embodiment, as shown in FIG. 8, the auxiliary support member 19 may be added to the outer side portion 8. This auxiliary support member 19 may be constituted for example by a lug glued or fixed in any other manner.

Figure 2:
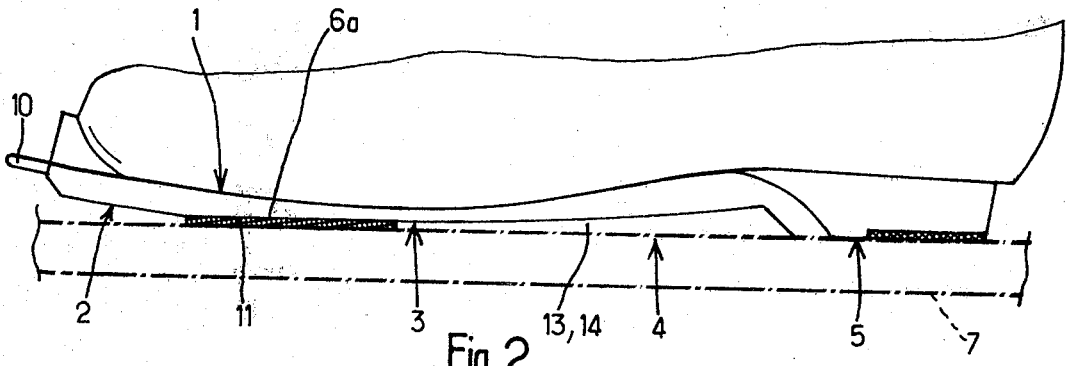
FIG. 2 is a view in partial elevation of a cross country ski boot according to the invention.

As shown in FIG. 2, the front end part 2 of the sole is preferably slightly inclined upwardly towards the front, from the plantar support zone 3. At its end, this front part 2 bears a member 10 ensuring connection of the boot with a binding device on the ski.

What is claimed is:

1. In a cross country ski boot comprising a sole made of moulded plastics material substantially in the form of a rectangle elongated in the longitudinal direction in its central part, said sole presents, in the front plantar zone, a central part of considerable thickness, with flat, relatively narrow lower surface, in contact with the top surface of the ski, which is divided into two by a longitudinal centering groove extending over the whole length of the central part of the sole and intended to cooperate with a rib of complementary shape provided on the top surface of the ski, and, on either side of this central part, two side portions whose thickness decreases towards the longitudinal edges of the sole, with flat or curved lower surfaces, inclined upwardly from the central part towards the longitudinal edges of the sole which are located at a level higher than that of the top face of the ski.

2. The ski boot of claim 1, wherein the flat central part is extended rearwardly by a portion of smaller width constituting two longitudinal ribs surrounding the longitudinal centering groove, these ribs respectively presenting lower edges of very small width facing the top face of the ski, and outer faces connecting these narrow edges to the longitudinal edges of the sole, these outer faces being inclined upwardly towards the corresponding longitudinal edge of the sole.

3. The ski boot of claim 1, wherein it comprises, beneath the sole, in the side portion of the plantar support zone located on the outer side of the boot, an auxiliary support member substantially coplanar with the flat central part, of small width, disposed between said flat central part and the longitudinal edge of the sole.

4. The ski boot of claim 1 wherein the auxiliary support member is moulded with the sole and is constituted by a wing extending laterally towards the outside from the flat central part, this wing terminating in a lower edge located substantially in the plane of the lower surface of the flat central part.

5. The ski boot of claim 4, wherein the edge of the wing, extending laterally, is connected to the rest of the side portion by curved surfaces.

6. The ski boot of claim 3, wherein the auxiliary support member is constituted by a lug connected beneath the sole, for example by gluing.

* * * * *